US011358251B2

(12) United States Patent
Liaw

(10) Patent No.: US 11,358,251 B2
(45) Date of Patent: Jun. 14, 2022

(54) GRINDING DEVICE FOR INNER HOLES

(71) Applicant: Jian-Shiou Liaw, Taichung (TW)

(72) Inventor: Jian-Shiou Liaw, Taichung (TW)

( * ) Notice: Subject to any disclaimer, the term of this patent is extended or adjusted under 35 U.S.C. 154(b) by 0 days.

(21) Appl. No.: 17/093,674

(22) Filed: Nov. 10, 2020

(65) Prior Publication Data

US 2022/0143773 A1 May 12, 2022

(51) Int. Cl.
*B24B 23/02* (2006.01)
*B24B 47/10* (2006.01)

(52) U.S. Cl.
CPC ..... *B24B 23/02* (2013.01); *B24B 47/10* (2013.01)

(58) Field of Classification Search
CPC ..... B24B 23/022; B24B 23/02; B24B 47/10
USPC ..... 451/344
See application file for complete search history.

(56) References Cited

U.S. PATENT DOCUMENTS 3,208,307 A * 9/1965 Bengt ..... F16H 13/08 475/904
3,872,951 A * 3/1975 Hastings, Jr. ..... B23Q 5/20 188/69
3,899,852 A * 8/1975 Batson ..... B24B 23/028 451/359
4,400,995 A * 8/1983 Palm ..... B23B 45/008 173/164
6,224,304 B1 * 5/2001 Smith ..... B23B 31/201 279/150
6,386,961 B1 * 5/2002 Cureton ..... B24B 23/02 451/354
7,128,641 B1 * 10/2006 Lin ..... B24B 23/022 451/359
2006/0027978 A1 * 2/2006 Young ..... B23B 31/1238 279/62
2008/0014844 A1 * 1/2008 Pontieri ..... B25F 5/001 451/359
2008/0090504 A1 * 4/2008 Trautner ..... B24B 23/00 451/359
2011/0039482 A1 * 2/2011 Timmons ..... B24B 23/022 451/344
2020/0191336 A1 * 6/2020 Critsinelis ..... G05D 16/2013

FOREIGN PATENT DOCUMENTS

EP 1952944 A1 8/2008
TW M592810 U 4/2020

* cited by examiner

*Primary Examiner* — Brian D Keller
(74) *Attorney, Agent, or Firm* — Bacon & Thomas, PLLC

(57) ABSTRACT

A grinding device for inner holes has a body, an extension shaft, a nut, and a button assembly. The body has a driving shaft rotatably disposed in the body and a containing hole disposed through a side of the body. The extension shaft has two ends and a concave structure. One of the two ends of the extension shaft is connected with the driving shaft of the body. The concave structure is disposed on the extension shaft, and is aligned with the containing hole of the body after the extension shaft rotates with the driving shaft. The nut is mounted on the other one of the two ends of the extension shaft. The button assembly is mounted in the containing hole of the body, and is able to be pressed and to extend into the concave structure to restrict the extension shaft from rotating.

6 Claims, 6 Drawing Sheets

GRINDING DEVICE FOR INNER HOLES

BACKGROUND OF THE INVENTION

1. Field of the Invention

The present invention relates to a grinding device, and more particularly to a grinding device for inner holes.

2. Description of Related Art

A conventional grinding device for inner holes comprises a body and a tool assembly. The body has a pneumatic motor disposed inside the body, and the pneumatic motor has a driving shaft. The tool assembly has an extension shaft, a collet, and a nut. The extension shaft is connected with the driving shaft of the pneumatic motor, and is thereby simultaneously rotatable with the driving shaft. The collet is mounted on an end of the extension shaft that is away from the driving shaft for installing a tool. The nut is mounted on the end of the extension shaft away from the driving shaft, so as to compress the collet and to stabilize the tool accordingly.

In use, a wrench is necessary for assembling and disassembling the nut. To avoid the nut rotating along with the extension shaft during the process of assembling and disassembling the nut, a user has to restrict the extension shaft with another wrench. The user may then disassemble the nut by rotating the extension shaft and the nut toward different directions, respectively.

However, in such operation, the user has both hands respectively holding the two wrenches, which means the user cannot hold the conventional grinding device with the user's hands. As a result, the conventional grinding device must be laid on a worktable during the disassembling process of the nut. To conclude, the nut of the conventional grinding device is not easy to be disassembled, and changing the tool fixed in the tool assembly is therefore a difficult task.

SUMMARY OF THE INVENTION

The main objective of the present invention is to provide a grinding device for inner holes, wherein the grinding device may restrict rotation of an extension shaft thereof via a button assembly.

The grinding device for inner holes comprises a body, an extension shaft, a nut, and a button assembly. The body has a driving shaft and an end cap. The driving shaft is rotatably disposed in the body. The end cap is mounted on a front end of the body by threads, is a circular structure, and has a containing hole disposed through a side of the end cap. The extension shaft is connected with the body and has two ends and a concave structure. One of the two ends of the extension shaft is connected with the driving shaft of the body. The concave structure is disposed on the extension shaft, and is aligned with the containing hole of the body after the extension shaft rotates with the driving shaft. The nut is screwed on the other one of the two ends of the extension shaft. The button assembly is mounted in the containing hole of the body, and is able to be pressed and to extend into the concave structure to restrict the extension shaft from rotating. The containing hole has an inner thread. The button assembly has a bolt, a rod, and a button. The bolt is hollow, is mounted in the containing hole, and is threaded with the inner thread of the containing hole. The rod is slidable, is inserted through the bolt, and is able to extend into the concave structure. The button is mounted on an end of the rod away from the concave structure. The button assembly has an elastomer sheathed on the rod, the elastomer has two ends, and each one of the two ends of the elastomer abuts a respective one of the bolt and the button. Before being pressed, the button is partially shielded in the containing hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
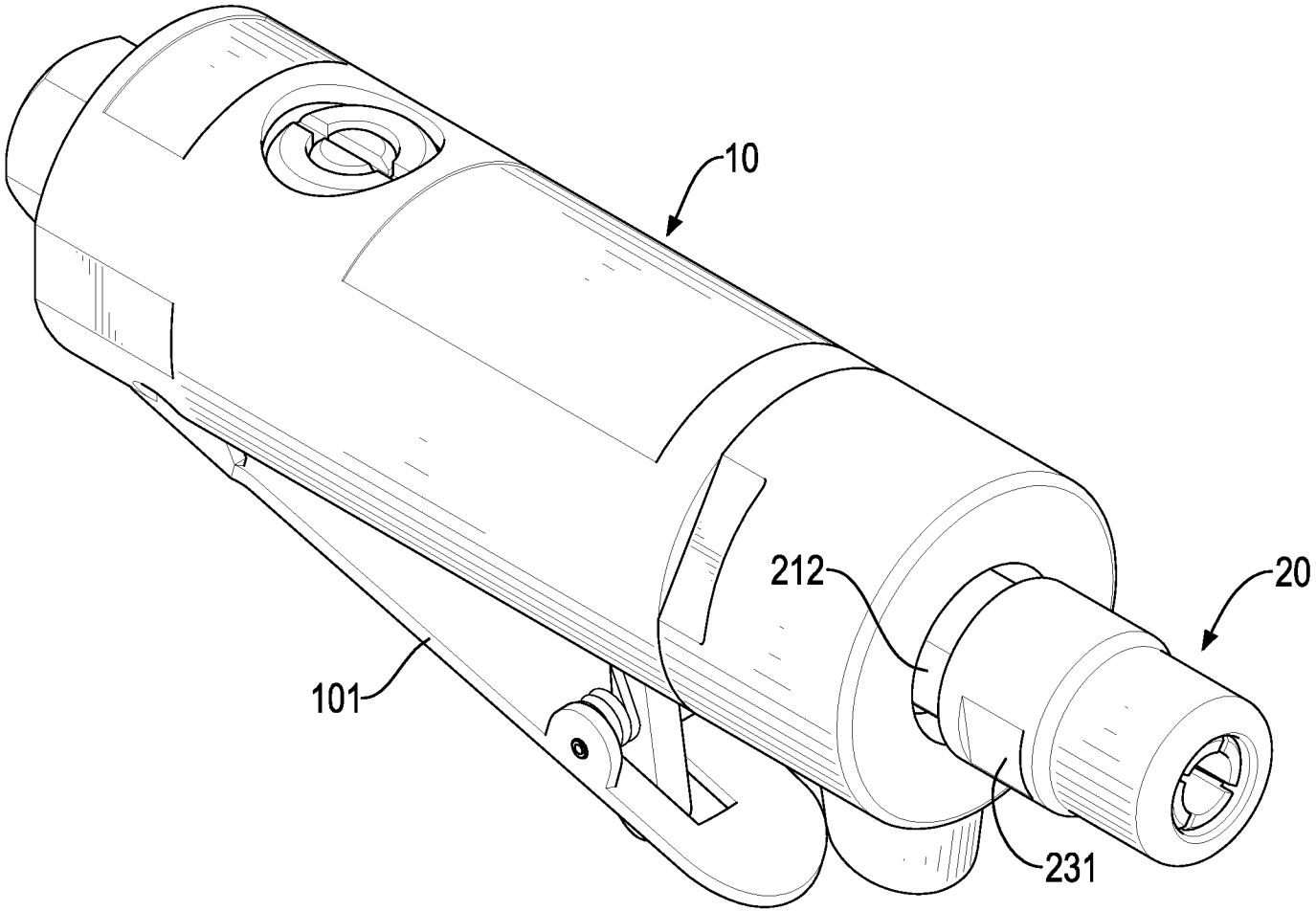
FIG. 1 is a perspective view of a grinding device for inner holes in accordance with the present invention.
Figure 2:
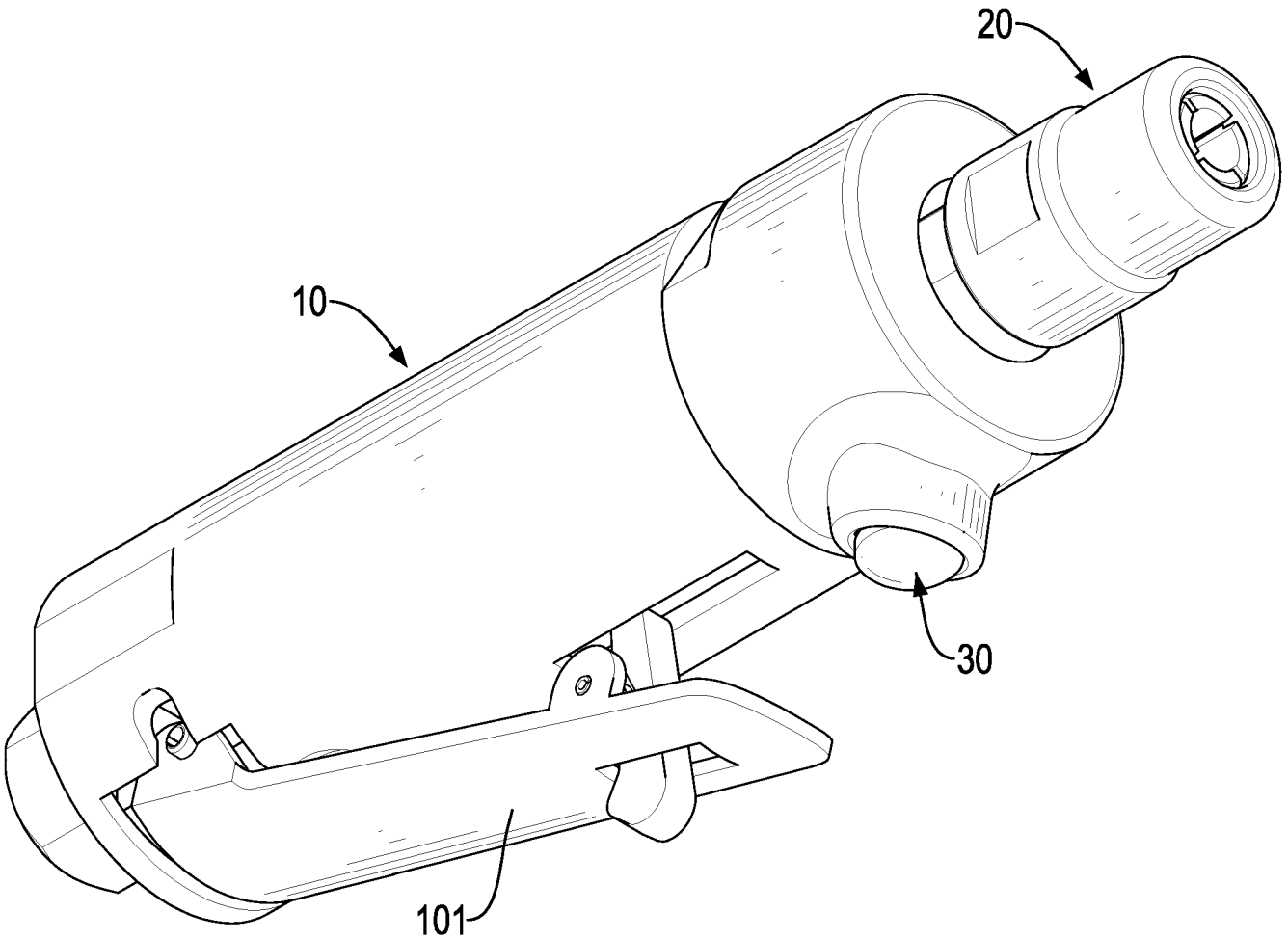
FIG. 2 is another perspective view of the grinding device in FIG. 1.
Figure 3:
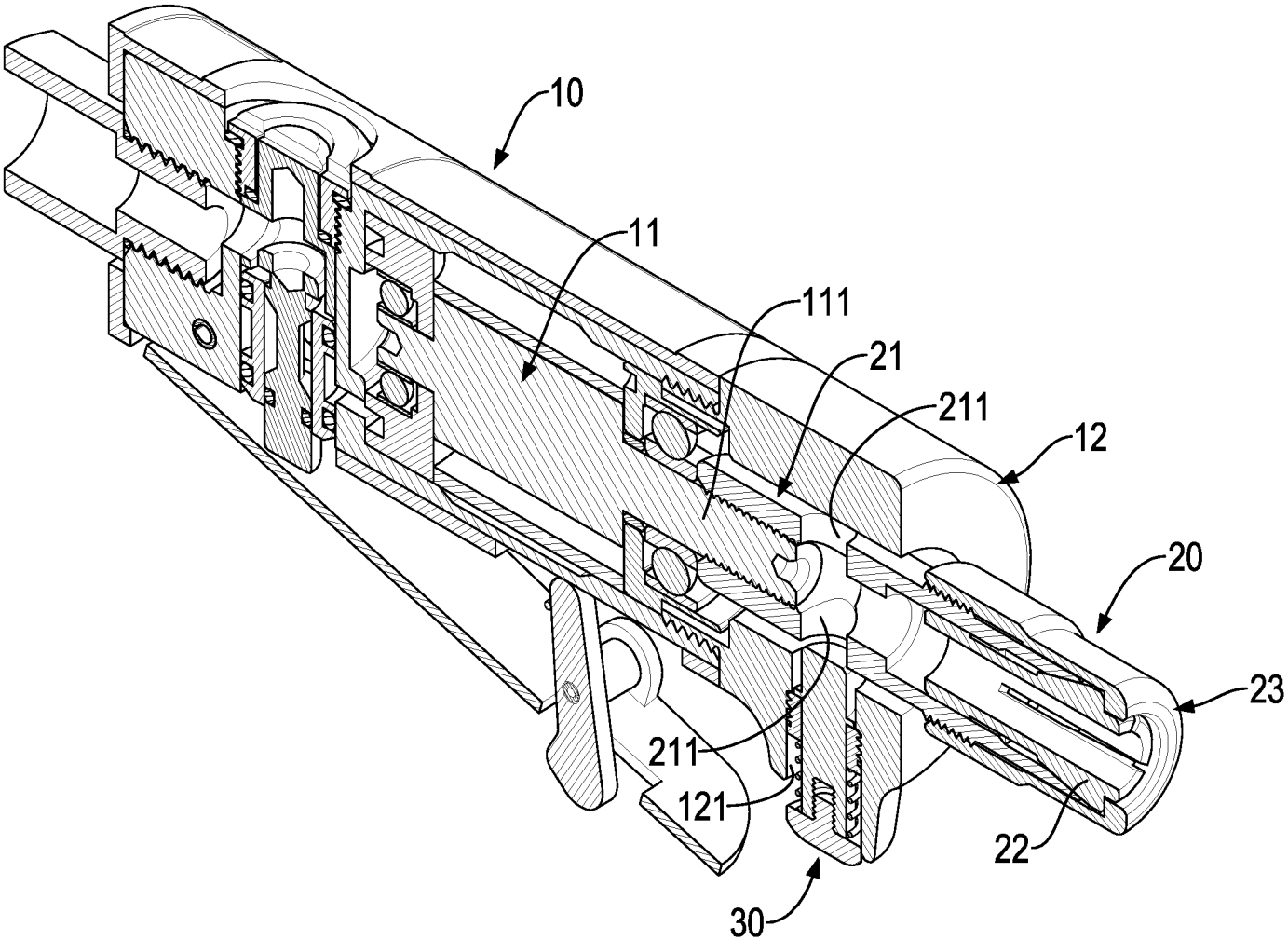
FIG. 3 is a perspective view in partial section of the grinding device in FIG. 1.
Figure 4:
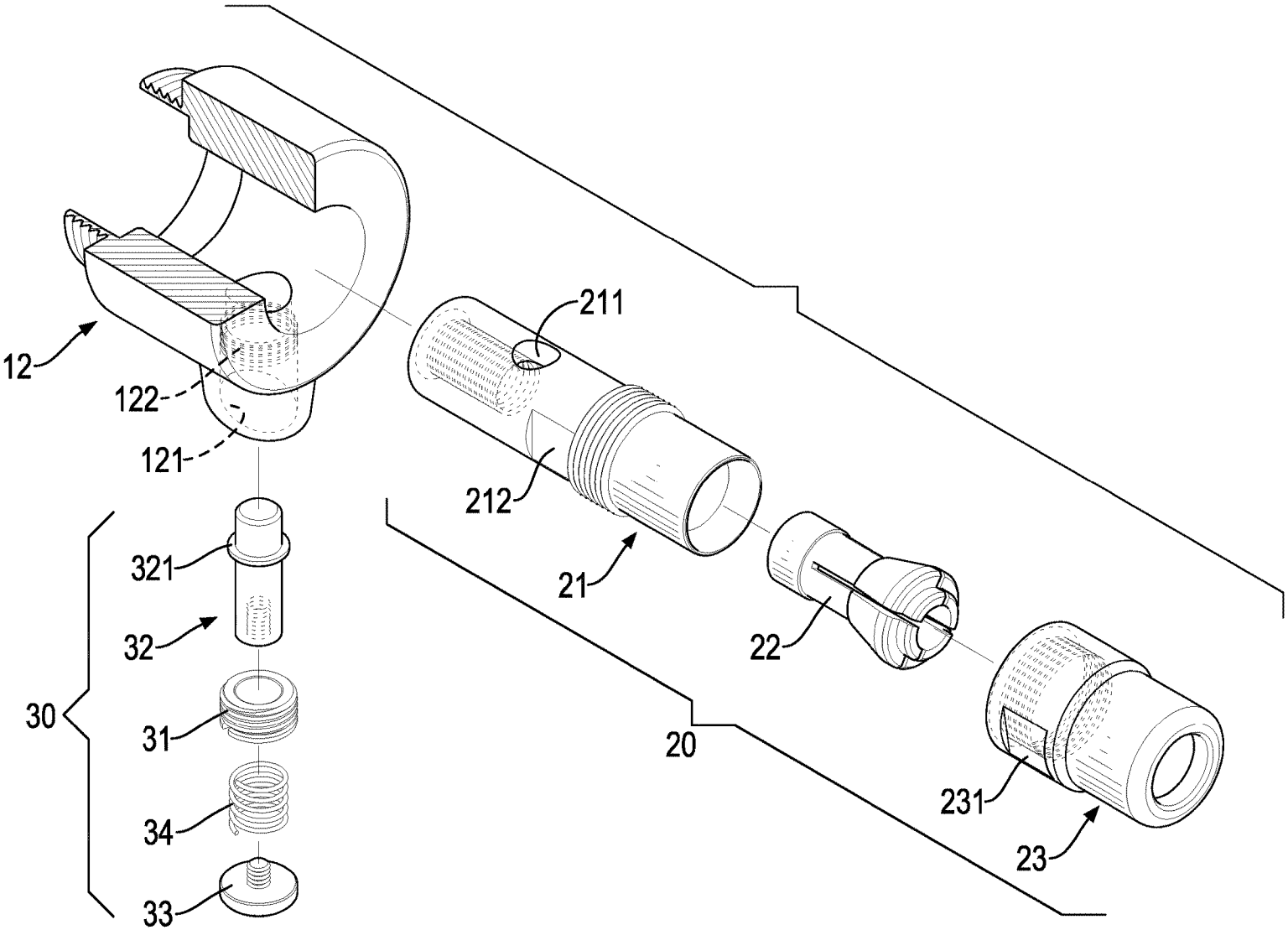
FIG. 4 is an exploded perspective view of a tool assembly and a button assembly of the grinding device in FIG. 1.

With reference to FIGS. 1 to 4, a grinding device for inner holes in accordance with the present invention has a body 10, a tool assembly 20, and a button assembly 30. The body 10 is formed substantially cylindrical, and is connected with a compressed air supply. The body 10 has a switch 101 and a pneumatic motor 11. The switch 101 is disposed on a side of the body 10. The pneumatic motor 11 is mounted in the body 10 and has a driving shaft 111. When a user presses the switch 101, gas under high pressure would be inlet into the body 10 via the compressed air supply, and the gas under high pressure may push the driving shaft 111 of the pneumatic motor 11 to rotate. Technical features of the switch 101 are same as those of the conventional grinding device, so detailed descriptions about the switch 101 are omitted.

Furthermore, the body 10 comprises an end cap 12 mounted on a front end of the body 10 by threads, so the pneumatic motor 11 may be kept in the body 10. The end cap 12 is a circular structure, and has a containing hole 121 disposed radially through a side of the end cap 12 and communicating with an inner space of the end cap 12. The containing hole 121 has an inner thread 122 disposed on a middle portion of the containing hole 121.

The tool assembly 20 is mounted with the body 10, and comprises an extension shaft 21, a collet 22, and a nut 23. The extension shaft 21 has one of two ends mounted with the driving shaft 111 of the body 10 by threads, and has at least one concave structure 211 disposed on the extension shaft 21. The at least one concave structure 211 may be aligned with the containing hole 121 of the body 10 as long as the extension shaft 21 rotates along with the driving shaft 111. In a preferred embodiment of the present invention, the extension shaft 21 is hollow, and has two said concave structures 211 diametrically opposed to each other. Each one of the two concave structures 211 may be sequentially aligned with the containing hole 121 as the extension shaft 21 keeps rotating. Furthermore, in the preferred embodiment, each concave structure 211 is a through hole disposed on the extension shaft 21. In other embodiments, the two concave structures 211 may be recesses as well.

The collet 22 is mounted in the other one of the two ends of the extension shaft away from the driving shaft 111 for installing a grinding tool. The nut 23 is mounted by threads on the corresponding end of the extension shaft 21, which is away from the driving shaft 111 so as to press the collet 22 and to stabilize the grinding tool therein. In the preferred embodiment of the present invention, each one of the extension shaft 21 and the nut 23 has a side surface for wrenching 212, 231, wherein the side surface for wrenching 212 of the extension shaft 21 is optional and can be omitted.

Figure 5:
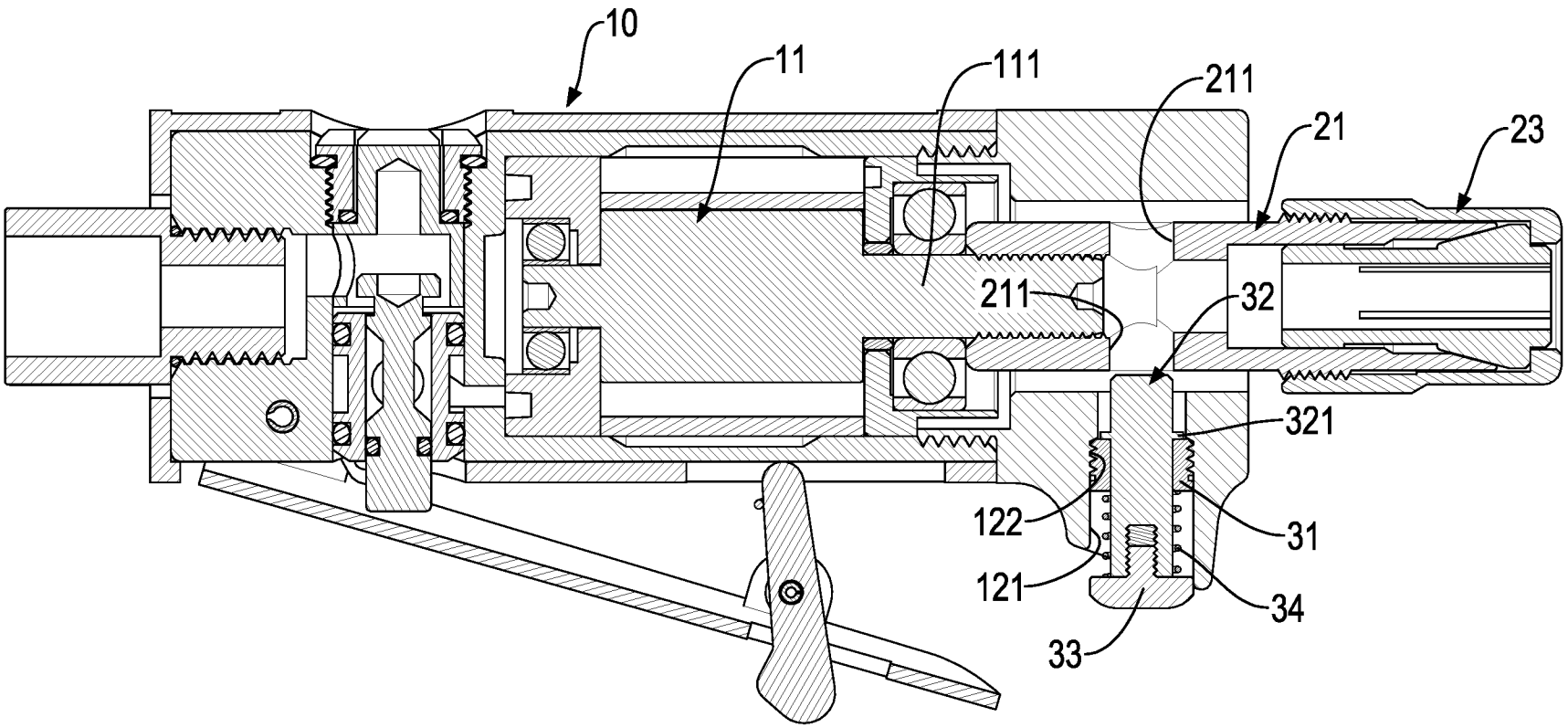
FIG. 5 is a side view in partial section of the grinding device in FIG. 1.

With reference to FIGS. 3 to 6, the button assembly 30 is mounted in the containing hole 121 of the body 10. The button assembly 30 may be pressed and extended into one of the concave structures 211 and stop the extension shaft 21 from revolving. The button assembly 30 has a bolt 31, a rod 32, a button 33, and an elastomer 34. The bolt 31 is hollow, and is threaded with the inner thread 122 in the containing hole 121. The rod 32 is slidable, and extends through the bolt 31. The rod 32 may extend into one of the two concave structures 211 so as to restrict movements of the extension shaft 21. Moreover, the rod 32 has a stopping flange 321 protruding radially on the rod 32 and located between the bolt 31 and the extension shaft 21. The button 33 is mounted by threading on an end of the rod 32 away from the extension shaft 21. The elastomer 34 is sheathed on the rod 32 and has two ends. Each one of the two ends of the elastomer 34 abuts a respective one of the bolt 31 and the button 33. With reference to FIG. 5, before being pressed, the button 33 is partially shielded in the containing hole 121.

Figure 6:
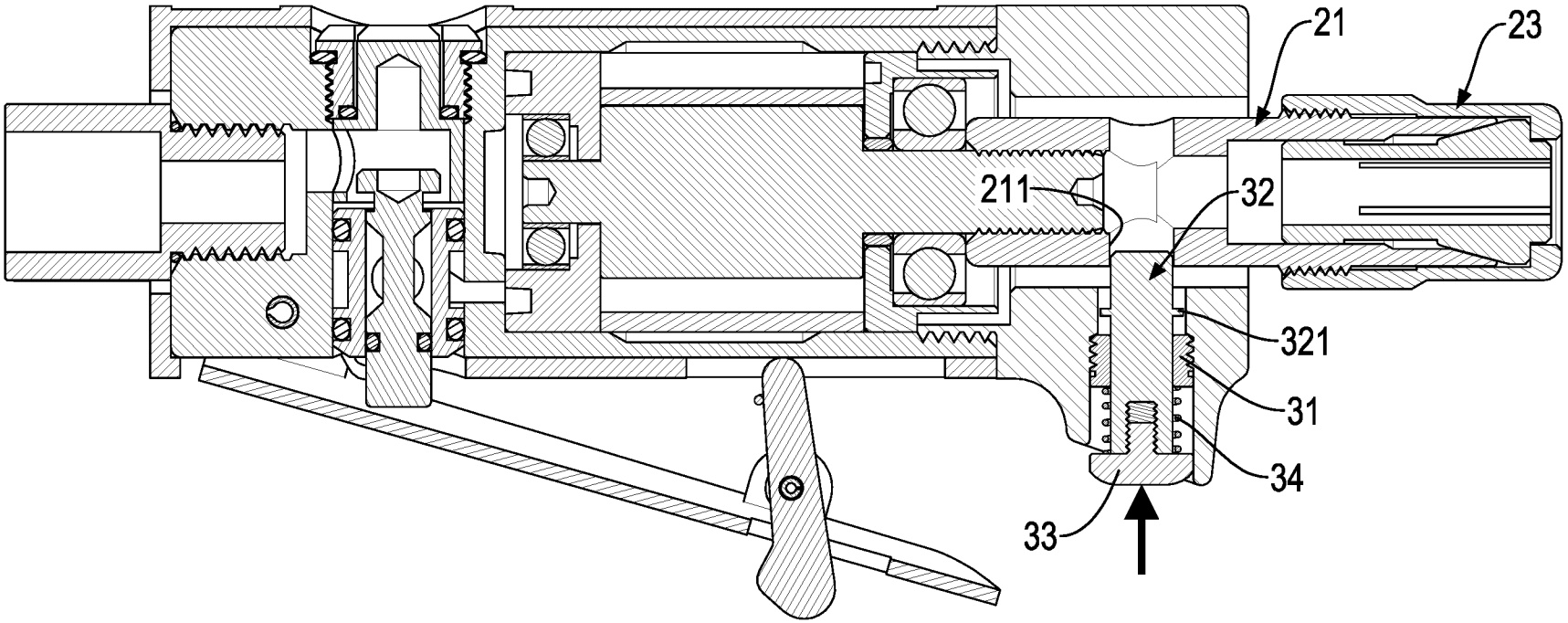
FIG. 6 is an operational side view of the grinding device in FIG. 1.

With reference to FIG. 5, before the button assembly 30 is pressed, the elastomer 34 pushes the button 33 in a direction away from the extension shaft 21. At this moment, the stopping flange 321 of the rod 32 abuts against the bolt 31 to prevent the rod 32 from falling off from the containing hole 121. With reference to FIG. 6, after the user presses the button 33, the button 33 moves toward the bolt 31 and compresses the elastomer 34. Simultaneously, the end of the rod 32 away from the button 33 extends into one of the two concave structures 211 to cause a restriction to the extension shaft 21 on rotating.

Besides, in case the button assembly 30 malfunctions, as the extension shaft 21 of the grinding device has the side surface for wrenching 212, the user may still disassemble the nut 23 by means of the conventional method.

With the aforementioned technical characteristics, the grinding device for inner holes of the present invention has the following advantages. When the user needs to disassemble the nut 23 for changing the grinding tool, the user may simply hold the body 10 with one of the user's hands, and press the button 33 of the button assembly 30 with a finger of that hand, e.g. the thumb of the hand. Then the extension shaft 21 may be fixed. The user may thus hold a wrench with the other hand, and disassemble the nut 23 with the wrench. Because the grinding device for inner holes is stably held by the user, even if the grinding device is suspended with no other supports, the user may still dismount the nut 23 with ease. Therefore, the present invention hereby provides a fine solution to the problems of the conventional grinding device including difficulties in disassembling the nut and changing grinding tools.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A grinding device for inner holes, and the grinding device comprising:
- a body having
  - a driving shaft rotatably disposed in the body; and
    - an end cap mounted on a front end of the body by threads, being a circular structure, and having
      - a containing hole disposed through a side of the end cap;
- an extension shaft connected with the body and having
  - two ends, and one of the two ends directly connected with the driving shaft of the body;
  - a concave structure disposed on the extension shaft, and aligned with the containing hole of the body after the extension shaft rotates with the driving shaft;
  - a nut mounted on the other one of the two ends of the extension shaft; and
  - a button assembly mounted in the containing hole of the end cap, and being able to be pressed and to extend into the concave structure to restrict the extension shaft from rotating; wherein
- the containing hole has an inner thread; and
- the button assembly has
  - a bolt being hollow, mounted in the containing hole, and threaded with the inner thread of the containing hole;
  - a rod being slidable, inserted through the bolt, and being able to extend into the concave structure; and
  - a button mounted on an end of the rod away from the concave structure;
  - the button assembly has an elastomer sheathed on the rod, the elastomer has two ends, and each one of the two ends of the elastomer abuts a respective one of the bolt and the button;
  - before being pressed, the button is partially shielded in the containing hole.

2. The grinding device for inner holes as claimed in claim 1, wherein the rod has a stopping flange protruding radially on the rod and located between the bolt and the concave structure.

3. The grinding device for inner holes as claimed in claim 2, wherein the concave structure is a through hole disposed on the extension shaft.

4. The grinding device for inner holes as claimed in claim 1, wherein the concave structure is a through hole disposed on the extension shaft.

5. A grinding device for inner holes, and the grinding device comprising:
- a body having
  - a driving shaft rotatably disposed in the body; and
    - an end cap mounted on a front end of the body by threads, being a circular structure, and having
      - a containing hole disposed through a side of the end cap;
- an extension shaft connected to the body and having
  - two ends, and one of the two ends directly connected with the driving shaft of the body;
  - multiple concave structures disposed on the extension shaft at spaced intervals, and each one of the multiple concave structures being able to be aligned with the containing hole of the body after the extension shaft rotates with the driving shaft;

a nut mounted on the other one of the two ends of the extension shaft; and a button assembly mounted in the containing hole of the end cap, and being able to be pressed and to extend into one of the concave structures to restrict the extension shaft from rotating; wherein the containing hole has an inner thread; and the button assembly has a bolt being hollow, mounted in the containing hole, and threaded with the inner thread of the containing hole;

a rod being slidable, inserted through the bolt, and being able to extend into one of the concave structures; and a button mounted on an end of the rod away from the extension shaft;

the button assembly has an elastomer sheathed on the rod, the elastomer has two ends, and each one of the two ends of the elastomer abuts a respective one of the bolt and the button;

before being pressed, the button is partially shielded in the containing hole.

6. The grinding device for inner holes as claimed in claim 5, wherein the rod has a stopping flange protruding radially on the rod and located between the bolt and the extension shaft.

* * * * *